United States Patent [19]

Fitzmayer

[11] Patent Number: 4,496,814

[45] Date of Patent: Jan. 29, 1985

[54] MICROWAVE EXCITATION SYSTEM

[75] Inventor: Louis H. Fitzmayer, Louisville, Ky.

[73] Assignee: General Electric Company, Louisville, Ky.

[21] Appl. No.: 457,038

[22] Filed: Jan. 10, 1983

[51] Int. Cl.[3] ..... H05B 6/70

[52] U.S. Cl. ..... 219/10.55 F; 219/10.55 A; 315/39.53; 333/24 C; 333/230

[58] Field of Search ..... 219/10.55 F, 10.55 R, 219/10.55 A, 10.55 B; 315/39.53; 333/24 C, 21 R, 230, 239, 248, 253

[56] References Cited

U.S. PATENT DOCUMENTS

| | | | |
|---|---|---|---|
| 2,972,084 | 2/1961 | Esterson et al. | 315/39.53 |
| 3,127,494 | 3/1964 | Kellough et al. | 219/10.55 F |
| 3,375,474 | 3/1968 | Thompson et al. | 333/21 |
| 3,375,476 | 3/1968 | Tibbs | 219/10.55 F |
| 3,377,562 | 4/1968 | Staats | 315/39.53 X |
| 3,461,261 | 8/1969 | Lewis et al. | 219/10.55 F |
| 3,471,671 | 10/1969 | Puschner | 219/10.55 F |
| 3,715,555 | 2/1973 | Johnson | 219/10.55 A |
| 3,764,770 | 10/1973 | Saad et al. | 219/10.55 F |
| 3,789,179 | 1/1974 | Haagensen | 219/10.55 F |
| 3,814,890 | 6/1974 | Klemp et al. | 219/10.55 F |
| 3,991,295 | 11/1976 | Akiyoshi | 219/10.55 F |
| 4,019,010 | 4/1977 | Tanaka et al. | 219/10.55 F |
| 4,105,886 | 8/1978 | Baron et al. | 219/10.55 E |
| 4,144,434 | 3/1979 | Chiron et al. | 219/10.55 F |
| 4,144,437 | 3/1979 | Ehlers | 219/10.55 F |
| 4,316,069 | 2/1982 | Fitzmayer | 219/10.55 F |
| 4,350,859 | 9/1982 | Dudley et al. | 219/10.55 F |

FOREIGN PATENT DOCUMENTS

| | | | |
|---|---|---|---|
| 3029035 | 2/1982 | Fed. Rep. of Germany | 219/10.55 F |
| 978197 | 12/1964 | United Kingdom . | |

*Primary Examiner*—Philip H. Leung

*Attorney, Agent, or Firm*—H. Neil Houser; Radford M. Reams

[57] ABSTRACT

A microwave excitation system for coupling microwave energy from a magnetron to a load via a waveguide of relatively compact dimensions open at one end for radiating energy therefrom and enclosed at the other end by a conductive end wall. A magnetron output probe extends axially into the waveguide through a central opening in the end wall of the waveguide. A cup-like member is mounted within the waveguide and inverted over the probe concentric therewith to capacitively couple microwave energy from the probe into the waveguide. The cup-like member is dimensioned to provide a matched load condition for the magnetron.

20 Claims, 8 Drawing Figures

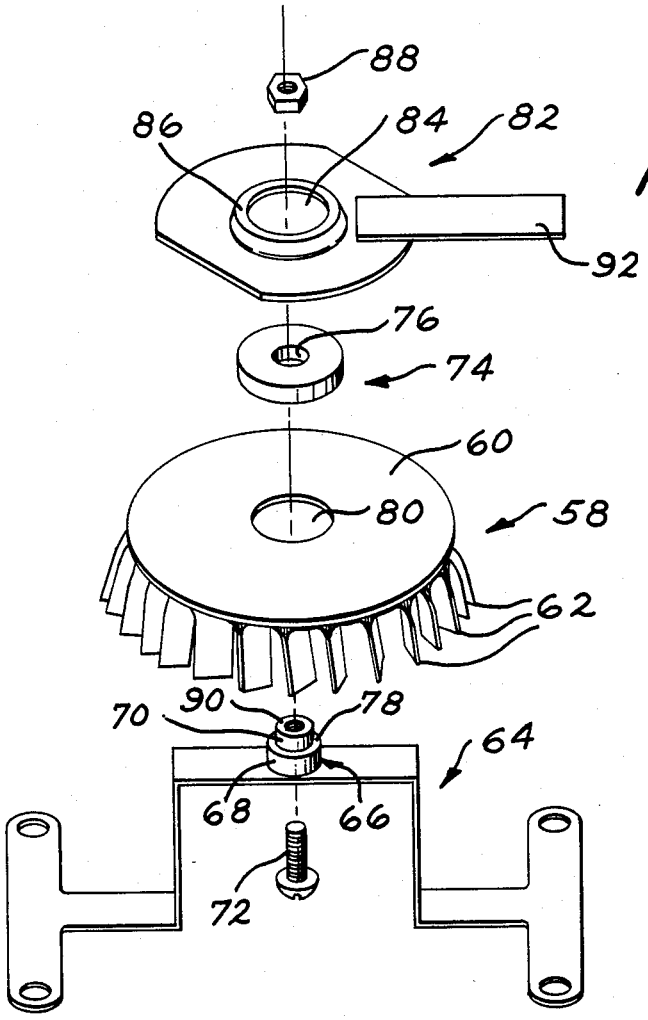
FIG. 4
FIG. 6
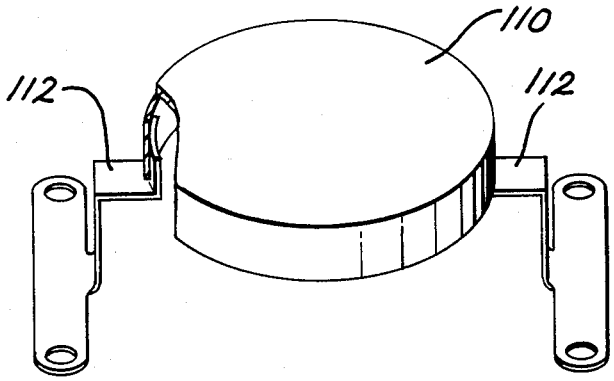

MICROWAVE EXCITATION SYSTEM

BACKGROUND OF THE INVENTION

The present invention relates to a microwave excitation system and more specifically to a system which couples a magnetron to a waveguide of relatively compact dimensions with no intermediate or transition waveguide structure. The present invention is an improvement of the excitation system disclosed and claimed in commonly-assigned U.S. Pat. No. 4,316,069 to the inventor of the present invention.

The above-referenced '069 patent discloses a microwave excitation system which provides an improved time-averaged energy distribution pattern for a microwave oven. That excitation system employes a circular waveguide section attached in a centrally located position to the bottom wall of the microwave oven cooking cavity. A rotatable antenna having a vertical segment and a horizontal arm is rotated to excite $TM_{01}$ the mode by the vertical segment and the $TE_{11}$ mode by the horizontal arm. These two modes interact to excite a rotating asymmetric electric field within the waveguide. This waveguide field is propagated into the oven cavity to produce a rotating field pattern of desirable time-averaged uniformity in the cavity during the cooking cycle. The excitation system further includes a rectangular waveguide section which couples microwave energy from the magnetron to the rotating antenna.

It would be advantageous to have the magnetron couple directly into the circular waveguide section, thereby eliminating the manufacturing and materials costs and the energy losses associated with the rectangular waveguide section, while retaining the radiating pattern provided by the system of the '069 patent. One difficulty with coupling the magnetron antenna probe directly into the circular waveguide results from the fact that because of the relative compact waveguide dimensions dictated, at least in part, by packaging and material cost constraints, and the required radiating probe length for satisfactory probe coupling, the probe may well have to extend beyond the waveguide into the cooking cavity itself.

Examples of excitation systems for microwave ovens which have eliminated the external rectangular waveguide are disclosed in U.S. Pat. No. 4,350,859 to Dudley et al and U.S. Pat. No. 4,105,886 to Baron et al. However, neither of the above-described excitation systems provides a radiation pattern in the oven similar to that of the '069 patent. In Dudley et al, the magnetron probe is inserted into a circular well extending from the oven cavity. A rotating feed structure comprising three waveguide sections is rotatably supported from the magneton probe. Each of the three waveguide chambers on the rotating structure has associated with it a radiating slot. Thus, the magnetron probe couples into the waveguide chambers of rotating waveguide structure with each chamber coupling energy to the cooking cavity via its associated radiating slot.

In Baron et al, a square housing which opens into the bottom of the oven cavity houses the magnetron probe in one corner thereof with a rotating mode stirrer centered in the housing. The energy propagating in the housing is deflected into random patterns by the mode stirrer which enters the cooking cavity. The corner location for the probe is probably dictated by magnetron loading requirements. One consequence of this location of the probe which is off-center relative to the oven cavity is that the resultant radiation patterns established in the cavity may be asymmetric with respect to the cavity, resulting in more energy being delivered to one part of the cavity than another, depending upon the effectiveness of the mode stirring arrangement in randomizing the patterns.

In view of the potential advantages associated with elimination of the external rectangular waveguide, it would be desirable to provide a microwave excitation system which eliminates the costs and energy losses associated with the external rectangular waveguide while providing a radiation pattern comparable to that provided by the '069 patent.

It is therefore an object of the present invention to provide a microwave excitation system particulary adaptable to microwave ovens which is of relatively simple, low cost construction, and which permits coupling the magnetron to a waveguide of relatively compact dimensions without using an external rectangular waveguide intermediate the magnetron and the waveguide for coupling energy from the magnetron to the guide.

SUMMARY OF THE INVENTION

This and other objects are accomplished by a microwave excitation system for coupling microwave energy from a magnetron to a load via a waveguide of relatively compact dimensions open at one end for radiating microwave energy therefrom and enclosed at the other end by a conductive end wall. A magnetron radiating probe extends axially into the waveguide through a central opening in the end wall. A cup-like member is mounted within the waveguide inverted over the probe and concentric therewith to capacitively couple microwave energy from the probe into the waveguide. An annular clearance is provided between the end wall of the guide and the open end of the capacitive coupling member. The capacitive coupling member is dimensioned to provide a matched load condition for the magnetron.

In accordance with a preferred form of the invention for microwave oven applications, the open end of the waveguide radiates into the cooking cavity of a microwave cooking appliance through an entrant cavity wall. The capacitive coupling member comprises a cup-like member which is rotatably mounted in the waveguide with at least one generally planar conductive arm extending radially from the cup to block radiation into the oven cavity from the region between the arm and the waveguide end wall. Means are provided to rotate the cup. Rotation of the cup varies the radiation pattern in the oven cavity, thereby enhancing the time-averaged uniformity of energy distribution within the cavity.

BRIEF DESCRIPTION OF THE DRAWINGS

While the novel features of the invention are set forth with particularity in the appended claims, the invention both as to organization and content will be better understood and appreciated from the following detailed description taken in conjunction with the drawings in which:

FIG. 4 is an exploded perspective view of the capacitive coupling cup member of FIG. 3 and its supporting structure;

FIG. 6 is a perspective view of the cup structure of FIG. 5;

DETAILED DESCRIPTION OF THE INVENTION

Figure 1:
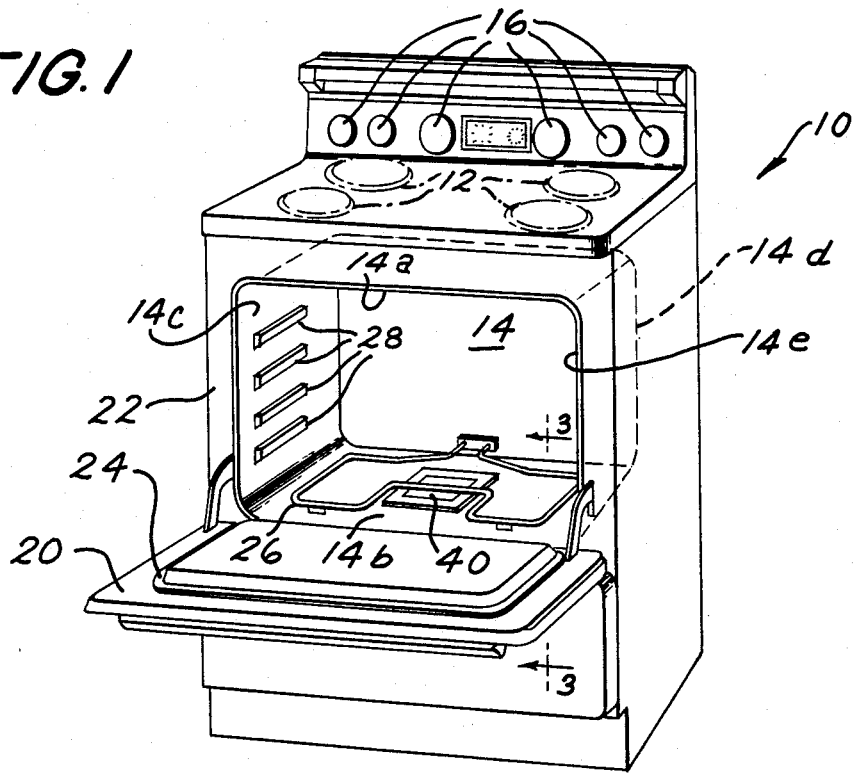
FIG. 1 is a perspective view of an electric range incorporating a microwave oven illustratively embodying the excitation system of the present invention.

Referring now to FIG. 1, there is shown a free standing electric range 10 which for the most part is conventional in construction, including surface heating units 12, an oven cavity 14 and related controls 16 mounted on back panel 18. Oven cavity 14 is formed by horizontal top and bottom walls 14*a*, 14*b* and upstanding side walls 14*c*, 14*d* and 14*e*. An oven door 20 is hingedly mounted on the front wall 22 of range 10 and may be provided with a fiberglass gasket 24 to provide a heat seal for oven cavity 14. When a microwave cooking operation is performed, it is necessary also to seal the periphery of the door against microwave energy leakage. To this end, gasket 24 may also include wire mesh inside the gasket. Other means of sealing against microwave energy leakage may also be employed in accordance with principles well known in the art. The oven includes a conventional lower bake heater unit 26 and an upper broiler heater unit (not shown). A series of parallel rack supporting ridges 28 are formed on side walls 14*c* and 14*e* such that conventional wire racks (not shown) may be slidably supported in the usual manner.

Figure 2:
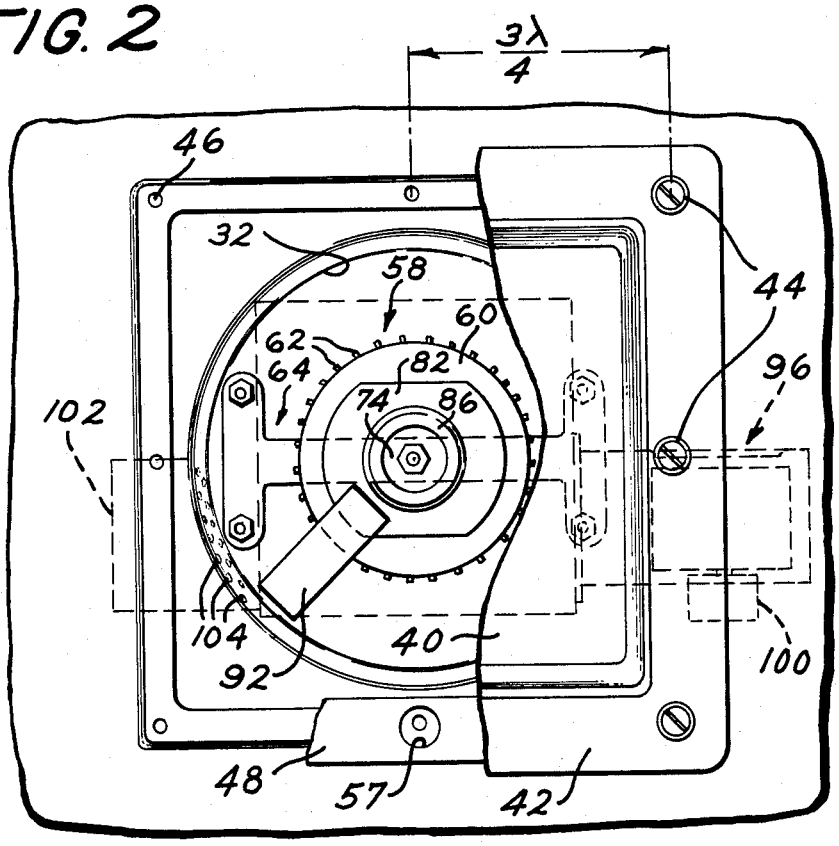
FIG. 2 is a partial plan view of the microwave excitation system of the oven of FIG. 1 with portions removed to illustrate details thereof.
Figure 3:
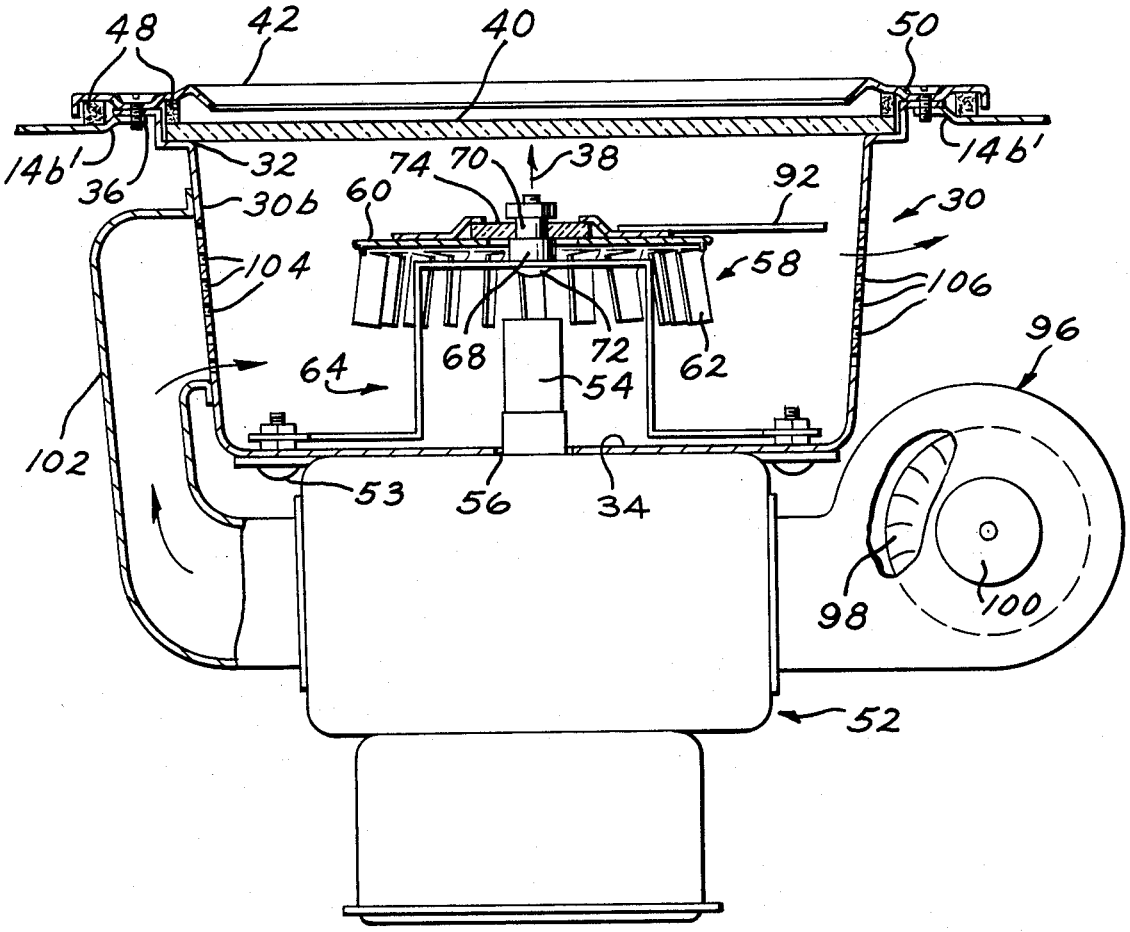
FIG. 3 is a cross-sectional view of the excitation system of FIG. 2 taken generally along lines 3—3 with portions removed to illustrate details thereof.

Referring now jointly to FIGS. 1–3, in accordance with the invention, a microwave excitation system includes a generally circular waveguide 30 open at one end 32 to radiate microwave energy therefrom and enclosed at the other end by conductive end wall 34. Waveguide 30 is located outside cavity 14 and is attached to bottom wall 14*b* with open end 32 of waveguide 30 aligned with and in mating engagement with a feed aperture 36 in bottom entrant wall 14*b*. Aperture 36 is preferably generally centrally positioned on bottom wall 14*b*, although the aperture may be located off-center. Also, the choice of bottom wall 14*b* as the entrant wall is dictated in the case of range 10 by factors unrelated to the invention, and any one of the other walls 14*a*, 14*c*, 14*d* or 14*e* might also be chosen, depending upon available space considerations. For example, in a counter top microwave oven, it is common practice to use the top wall as the entrant wall and this invention may also be employed in such a manner.

Waveguide 30 is attached to entrant wall 14*b* with its guide or propagation axis 38 perpendicular to entrant wall 14*b*. Waveguide 30 may be formed out of a square metal sheet by a draw process and thus for convenience a slight taper in the side 30*b* of the guide is provided. Upper end 32 of waveguide 30 is covered by a layer or plate 40 of a low dielectric material such as, for example, a glass ceramic. The basic functioning of plate 40 is to prevent food soil and other objects from entering waveguide 20. Plate 40 is held in place by a metal trim frame 42 attached to waveguide 30 and entrant wall 14*b* by means of screws 44 through mating screw holes 46. Gasket 48 is provided to electrically insulate trim frame 42 from waveguide 30 and entrant wall 14*b* except at the contact points provided by screws 44. More specifically, frame 42 is provided with depressions 50 around screw holes 46 that nest into mating holes 51 in gasket 48 to assure contact with waveguide 30 and a entrant wall 14*b*. Entrant wall 14*b* has a slightly raised portion 14*b*′ to prevent food soils inside cavity 14 from entering waveguide 30 and to assure that trim frame 42 does not contact entrant wall 14*b* except at the screw contact points. The screw contact points are spaced apart by a distance of $3\lambda/4$ to assure that circulating currents are not extablished in trim frame 42 which thereby has the effect of suppressing unwanted load-in of microwave energy into trim frame 42 which, if allowed to occur, would reduce the feed in of energy into oven cavity 14.

Further in accordance with the invention, microwave energy is supplied by a conventional magnetron designated generally 52, operating preferably at the standard frequency of 2450 MHz. At this frequency, the free space wavelength, $\lambda$, is approximately 4.8″. Reference to "wavelength" or $\lambda$ hereinafter shall be understood to mean free space wavelength. Magnetron 52 is secured to end wall 34 of waveguide 30 by mounting screws 53. Output antenna probe 54 of magnetron 50 extends axially into the interior of waveguide 30 through a central opening 56 in end wall 34, to excite a predetermined microwave energy propagating mode preferably the $TM_{01}$ mode in waveguide 30.

It will be recalled from the Background discussion that it is desirable to improve the microwave oven excitation system disclosed in U.S. Pat. No. 4,316,069 by eliminating the conventional external rectangular waveguide while radiating a comparable time-averaged radiation pattern in the cooking cavity. One requirement for radiating a comparable radiation pattern is to excite the $TM_{01}$ mode in waveguide 30. To efficiently excite the $TM_{01}$ mode and properly match the magnetron by probe coupling in the waveguide structure thus far described, the radiating probe would need to be substantially longer than the typical radiating stub or probe built into the conventional magnetron. A probe of the same diameter as the magnetron probe would necessarily extend into the waveguide a distance on the order of a half wavelength, or greater, for acceptable coupling. However, because of space limitation beneath the oven cavity and in order to minimize the materials costs and, perhaps most importantly to establish the $TM_{01}$ mode as the primary propagating mode in the waveguide, the circular waveguide 30 is of relatively compact dimensions, i.e., diameter less than $3\lambda/2$ and preferably on the order of $\lambda$ and length not substantially greater than $\lambda/2$. Clearly, a probe length on the order of $\lambda/2$, or greater, is undesirable in such a waveguide as it would require an extension to the conventional magnetron probe which would likely extend into the cooking cavity.

This difficulty is overcome in accordance with the present invention by providing a generally cup-like member in the circular waveguide, concentric with the waveguide, and inverted over the magnetron probe which capacitively couples microwave energy from the magnetron to the circular waveguide. The exact configuration and dimensions of the cup-like member can be selected empirically to provide a matched load condition for the magnetron, thereby providing good coupling using the standard magnetron probe. As used herein the term "matched load condition" is defined as the condition which provides a unity voltage standing wave for the magnetron when the guide is coupled to a particular load. For microwave oven applications, a free space load typified by the microwave oven cavity 14 with its door 20 open and the ceramic plate 40 removed has been found to provide a satisfactory load for tuning purposes.

It has been observed that a capacitive coupling member which provides the above-defined matched load condition can take a variety of configurations provided that the member comprises a hollow enclosure open at at least one end and having conductive walls having portions which are projectable onto a horizontal plane and portions projectable onto a vertical plane relative to the axis of propagation in the circular waveguide, or portions tapered so as to be projectable onto both a horizontal and a vertical plane. At one extreme, a cylinder open on both ends having only vertically projectable wall sections has been shown to be an ineffective coupling member. At the other extreme, a planar disc has also been found to be an ineffective coupling member. Within these extremes, however, numerous shapes could be employed. For example, as will be described in detail hereinafter, a cylinder open on one end and fully or partially enclosed at the other end has provided satisfactory coupling, as has a truncated cone-shaped member, with the smaller diameter end open or closed. The addition of an annular radially extending flange about the large diameter end of a truncated conical member has also been satisfactorily demonstrated.

The particular shape and size to meet particular spacing and load matching requirements can be empirically determined using a conventional impedance probe and a conventional network analyzer. Such apparatus was used in deriving dimensions for the illustrative embodiments to be hereinafter described. Coupling members were tested in the excitation system for oven cavity 14 with the impedance probe inserted in waveguide 30 in place of the magnetron probe 54. The optimum dimensions were selected as those dimensions which provided the hereinbefore defined matched load condition, i.e., provided an operating point for the magnetron at the center of a Reike Diagram with the oven door open and the dielectric cover plate removed. Obviously, other criteria could be used to define the desired operating point; however, good load matching for various food loads for the oven of FIG. 1 has been achieved using this criteria.

Referring again to FIGS. 2–4, in accordance with one form of the invention the capacitive coupling member is provided in the form of a generally cylindrical cup-like member designated generally 58 which is rotatably mounted in waveguide 30 concentric therewith and inverted over magnetron probe 54. Cup member 58 is fabricated from sheet metal and comprises a generally planar portion 60 and a cylindrical portion comprising a plurality of closely spaced axially extending vanes 62 formed at the periphery of planar portion 60. The close spacing of vanes 62 satisfactorily approximates a continuous cylindrical wall for microwave coupling purposes, that is, the vane configuration is effectively the electrical equivalent of a continuous cylindrical wall. Vanes 62 facilitate air driven rotation of cup member 58. It is understood that a smooth continuous cylindrical wall could be employed as well where other means for rotating the cup member are provided.

Cup member 58 is supported in waveguide 30 by an inverted U-shaped bracket and bearing system. The U-shaped bracket 64, formed of sheet metal for structural rigidity, is suitably secured to end wall 34 of waveguide 30 such as by magnetron mounting screws 53, thereby electrically grounding the bracket at the screw points. A stainless steel bearing 66 comprising a base portion 68 and an upper portion 70 of reduced cross-section is secured by internal threads to bracket 64 by mounting bolt 72 which extends therethrough. Cup member 58 is rotatably supported from bearing 66 by an annular ceramic spacer 74 which also serves to electrically insulate cup 58 from bearing 66 and grounded support bracket 64. The central opening 76 in spacer 74 is sized to loosely fit the reduced diameter portion 70 of bearing 66 to permit spacer 74 freely rotate relative to the bearing. Shoulder 78 of bearing 66 at the intersection of the reduced diameter portion 68 from the base portion 70 provides axial support for spacer 74. Opening 80 in planar portion 60 of cup member 58 is greater than the outer diameter of base portion 68 of bearing 66 to provide an annular clearance between bearing 66 and planar portion 60 serving to electrically insulate one from the other. Spacer 74 is sandwiched between planar portion 60 of cup 58 and a second generally planar structural member 82 which is suitably secured to planar portion 60 such as by spot welding. Structural member 82 has an oversized central opening 84 of comparable diameter to opening 80 in planar portion 60 and is concentrically aligned therewith. A raised annular flange 86 is formed in member 82 about opening 84 defining an annular recessed area to receive spacer 74. Flange 86 centers spacer 74 such that openings 84, 76 and 80 in structural member 82, spacer 74 and planar portion 60 of cup member 58, respectively, are concentrically aligned. The cup is secured to the bracket and bearing assembly by nut 88 which is threaded onto bolt 72 into abutting engagement with the upper surface 90 of bearing 66. This nut limits axial movement of cup member 58.

The cup member described thus far provides the desired coupling of energy from the magnetron to the circular waveguide. However, the resultant radiation pattern established in the cavity would hn a stationary, generally symmetric pattern. As mentioned hereinbefore, a dynamic radiating pattern comparable to that provided by the excitation system of the '069 patent, is preferred. To this end a generally planar conductive arm 92 extends radially from structural member 82 in a plane substantially parallel to the planar portion 60 of cup member 58. The length of arm 92 measured from the axis of propagation is on the order of $\lambda/2$, leaving just enough clearance between the distal end of the arm and the waveguide wall to avoid arcing. A clearance on the order of 0.10 inches is considered sufficient. Arm 92 tends to block radiation from regions between the arm and end wall 34 of waveguide 30. In the illustrative embodiment, arm 92 is a sheet metal strip spot welded to structural member 82. However, the arm could be integrally formed with member 82 or cup member 58.

In the illustrative embodiment of FIGS. 2–4, means for rotating the cup member is provided in the form of an air drive arrangement in which air is blown over the vanes 62 to rotate cup member 58. Blower 96 comprising fan 98 driven by a motor 100 directs a stream of air across the cooling fins (not shown) of magnetron 52 for cooling. A portion of this air is then channeled by duct section 102 into waveguide 30 through perforations 104 in waveguide 30. This air impinges on vanes 62, thereby causing clockwise rotation of cup member 58 as viewed in FIG. 2; the air then exits through perforations 106 in guide 30. This flow path is indicated by arrows in FIG. 3. While an air drive arrangement is employed in the illustrative embodiment of FIGS. 2–4, it will be appreciated that other means of rotating the cup, such as a motor drive arrangement, could be employed.

In operation of the microwave excitation system of FIGS. 2–4, when power is applied to magnetron 52 microwave energy from probe 54 is capacitively coupled by cup member 58 into waveguide 30 establishing a stationar $TM_{01}$ field mode as the primary propagating mode in waveguide 30. The field established in the waveguide radiates into cavity 14. Conductive arm 92 tends to block radiation from the region of the guide directly beneath the arms, i.e., between the arms and end wall 34. The blocked region in effect rotates with cup member 58, thereby introducing an essentially asymmetric radiation pattern which appears to rotate with cup member 58.

Qualitatively, absent conductive arm 92 the $TM_{01}$ mode excited in waveguide 30 would provide a generally annular radiation pattern in cooking cavity 14 with a region of low horizontal field intensity centered over the axis of propagation 38. The apparent effect of arm 92 is to shift the generally circular radiation pattern established in the cooking cavity laterally in the opposite direction from the arm, thereby laterally shifting the area of low horizontal field intensity normally centered about the axis of propagation. Thus, as the arm rotates, the low intensity region rotates as well. Such rotation tends to enhance the time-averaged uniformity of the energy distribution in the cavity achieving average energy distribution patterns which are generally comparable to that provided by the excitation system described in the hereinbefore referenced U.S. Pat. No. '069.

While in the illustrative embodiment of FIGS. 2–4 a single radial arm 92 is provided, multiple arms could be similarly employed. The resulting field pattern established in the oven cavity would be determined by the particular arm pattern selected.

By way of example, with no intention to be limited thereto, the following dimensions were employed in the actually constructed embodiment of FIGS. 2–4. The axial length of circular waveguide 30 is approximately one half wavelength (2.4 inches). The nominal diameter of guide 30 is just slightly greater than one wavelength or approximately five inches. Cup 58 has a diameter of approximately three inches and a length of approximately $\frac{3}{4}$ inches. These dimensions were empirically determined to provide the hereinbefore defined matched load condition for an axial clearance between probe 54 and planar portion 60 of cup 58 of 0.5 inches. This clearance approximates the vertical clearance employed between the magnetron probe and the top wall of the conventional external rectangular waveguide. The dimensions for bracket 64 were chosen to minimize the effect of the bracket on system impedance loading and radiation patterns. To this end, the width of the bracket is approximately $\frac{1}{2}$ inch. The length of the upper horizontal portion 64*a* was chosen to be slightly less than $\lambda/2$ or two inches. The length measured along a longitudinal center line for the bracket from screws 53 to the intersection with the vertically extending legs 64*b* and 64*c* is slightly less than $\lambda/2$, or approximately 2 inches, to provide a low impedance point at these intersections. The length of vertical legs 64*b* and 64*c* is also approximately $1\frac{1}{2}$ inches to provide the desired clearance between probe 54 and cup 58. Probe 54 extends into waveguide 30 a distance of approximately one inch which is slightly less than a quarter wavelength.

Figure 5:
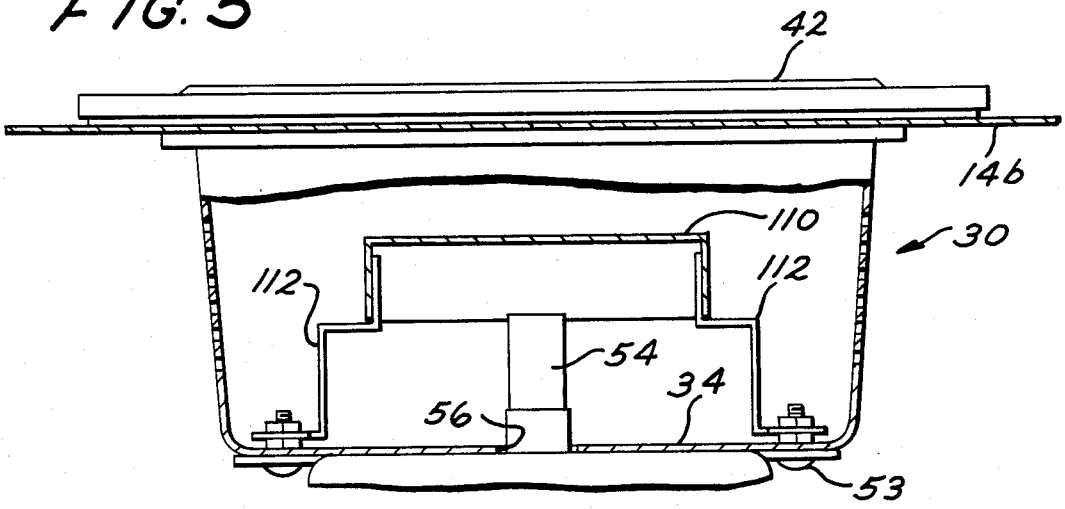
FIG. 5 is a cross-sectional view of an excitation system similar to that of FIG. 3 illustratively embodying another form of the capacitive coupling member in accordance with the invention.

The embodiment of FIGS. 2–4 hereinbefore described is considered preferable in the microwave oven environment because of the greater time-averaged uniformity of energy distribution in the cavity provided by the rotating radiation pattern in the cavity. However, in certain microwave excitation applications incorporating a circular waveguide where a stationary radiation pattern is acceptable, a stationary cup-like member could be satisfactorily employed to capacitively couple the magnetron to the waveguide. FIGS. 5 and 6 illustrate an embodiment of a stationary cup which could be substituted for rotating cup member 58 in the excitation system of FIGS. 2–4. Cylindrical cup 110 is an integrally formed conductive metallic cup. The axial spacing of cup 110 in waveguide 30 relative to magnetron probe 54 and end wall 34 are the same as hereinbefore described for the rotating cup embodiment. The length and width are essentially the same as that for cup 58, which dimensions provide the matched load condition when guide 30 radiates into free space. The support legs 112 in FIG. 5 are formed of a low loss dielectric material such as tetrafluoroethylene (Teflon) to electrically insulate cup 110 from guide 30. In operation, when power is applied to the magnetron, cup 110 capacitively couples energy from magnetron probe 54 to guide 30 to establish the $TM_{01}$ mode in the guide. The resultant radiation pattern established in cavity 14 will differ from that described hereinbefore in that the pattern will be an essentially stationary symmetric pattern.

Figure 7:
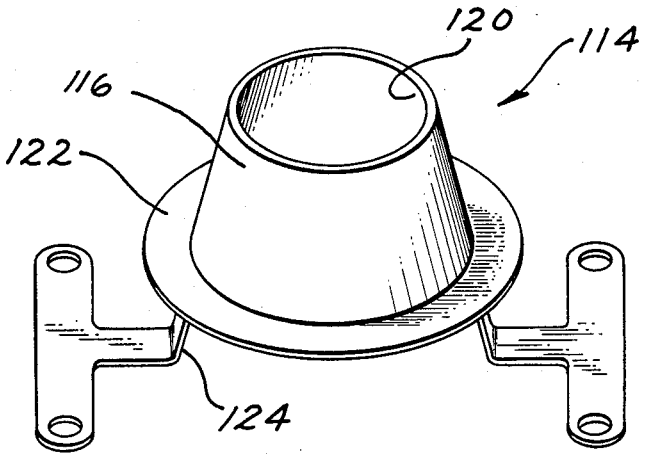
FIG. 7 is a perspective view of another embodiment of the capacitive coupling member.
Figure 8:
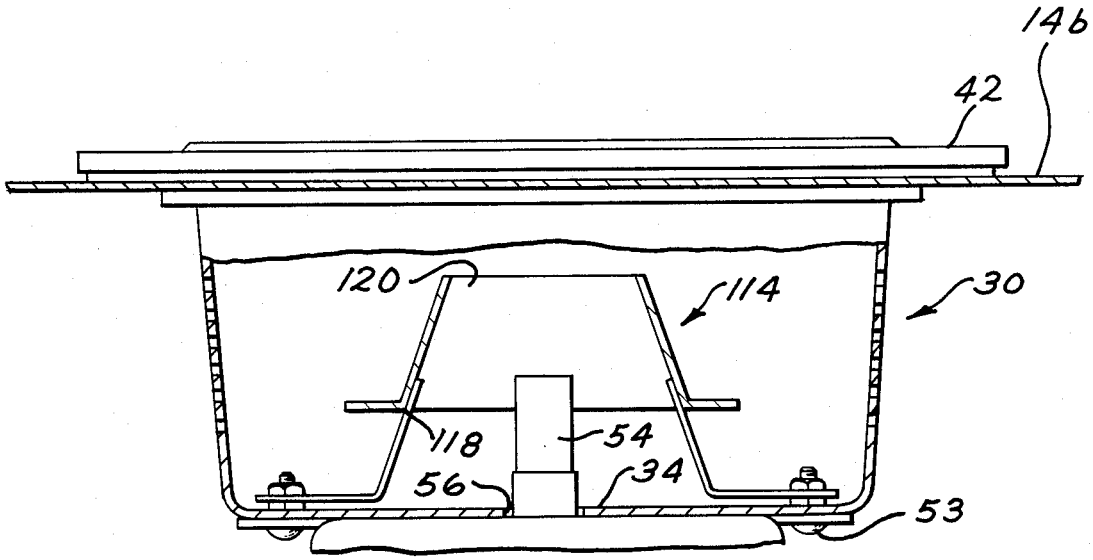
FIG. 8 is a cross-sectional view similar to that of FIGS. 3 and 5 illustratively incorporating the capacitive coupling member of FIG. 7 in the excitation system of the invention.

FIGS. 7 and 8 illustrate yet another embodiment of a capacitive coupling member which could be substituted for cup member 58 in the excitation system of FIGS. 2–4. In this embodiment, capacitive coupling member designated 114 comprises a truncated conic section 116 having a bottom opening 118 and a relatively smaller diameter top opening 120. An annular radially extending flange 122 is formed about the periphery of the bottom opening 118. Member 114 is supported by support legs 124 preferably formed of a low loss dielectric material similar to legs 112 in FIGS. 5 and 6.

The following dimensions for the coupling member of FIGS. 7 and 8 have been found to provide the matched load condition, when substituted for coupling member 58 in waveguide 30 of FIGS. 2–4. The diameter of openings 118 and 120 are 2 5/16 inches and 1 13/16 inches, respectively. The height of conic section 116 is one inch and the width of flange 122 is $\frac{5}{8}$ inch. Axial spacing between end wall 34 of waveguide 30 and flange 122 is approximately $\frac{7}{8}$ inch.

Annular flange 122 is provided to enable the desired capacitive coupling function to be performed using a smaller diameter cone than would be required if only a conical member with no flange is used. Use of a conic member without a flange could be similarly employed that would necessarily be larger and may require different spacing relative to end wall 34 of guide 30. In FIGS. 7 and 8, the top of conic section 116 is open. However, it has been observed that closing the top with a metal cover has no appreciable effect on system tuning. Thus, a truncated conic member with or without a flange, and either closed or open at the top end, can be dimensioned to provide the desired matched load condition.

While in accordance with the patent statutes, specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A microwave excitation system comprising:

a waveguide open at one end for propagating microwave energy therethrough along a centrally extending propagation axis, the other end thereof being terminated by a conductive end wall having an aperture formed therein centrally of said waveguide;

a magnetron for generating microwave energy having an output probe, said output probe extending axially into said waveguide through said aperture in said end wall to excite a predetermined propagating mode in said waveguide;

a generally cup-like member disposed within said waveguide inverted over said probe, said cup-like member being electrically insulated from said waveguide and operative to capacitively couple microwave energy from said magnetron to said waveguide, said cup-like member being dimensioned to provide a matched load condition for said magnetron.

2. The excitation system of claim 1, wherein said cup-like member is mounted in said waveguide for rotation about said axis of propagation;

said system further comprising at least one generally planar conductive arm lying substantially in a plane perpendicular to the axis of propagation and of said waveguide extending radially from said cup-like member, said arm being operative to block radiation out of said waveguide from that region of the waveguide between said arm and said end wall; and means for rotating said cup-like member, whereby rotation of said cup-like member varies the radiation pattern of microwave energy exiting said waveguide.

3. The excitation system of claim 2 wherein said conductive arm is generally coplanar with the planar portion of said cup-like member.

4. The excitation system of claim 3 wherein said waveguide is of generally circular configuration, having a diameter not substantially greater than one wavelength and a length not substantially greater than one-half wavelength, and wherein the axial projection of said probe into said guide is not substantially greater than one-quarter wavelength.

5. The excitation system of claim 4 wherein said cylindrical portion of said cup-like member comprises a plurality of closely spaced axially extending vanes, and wherein said means for rotating said cup comprises a blower for directing cooling air over said magnetron, and means for directing at least a portion of said cooling air into said waveguide to strike said vanes, thereby rotating said cup-like member.

6. The excitation system of claim 5 further comprising an oven cavity having top, bottom and side walls, and wherein said open end of said circular waveguide radiates through an opening in one of said walls into said cavity.

7. The excitation system of claim 1 wherein said cup-like member comprises a generally cylindrical member having a circular planar portion disposed perpendicular to said axis of propagation and a hollow, generally cylindrical portion extending axially from said planar portion toward said end wall, the diameter and length of said cylindrical member being selected to provide a matched load condition for said magnetron.

8. The excitation system of claim 7 wherein said waveguide is of generally circular configuration, having a diameter not substantially greater than one wavelength and a length not substantially greater than one-half wavelength, and wherein the axial projection of said probe into said guide is not substantially greater than one-quarter wavelength.

9. The excitation system of claim 8 further comprising an oven cavity having top, bottom and side walls, and wherein said open end of said waveguide radiates through an opening in one of said walls into said cavity.

10. The excitation system of claim 1 wherein said cup-like member comprises a hollow truncated conical portion with a radially outwardly extending planar flange formed about said conical section.

11. The excitation system of claim 10 wherein said waveguide is of generally circular configuration, having a diameter not substantially greater than one wavelength and a length not substantially greater than one-half wavelength, and wherein the axial projection of said probe into said guide is not substantially greater than one-quarter wavelength.

12. The excitation system of claim 11 further comprising an oven cavity having top, bottom and side walls, and wherein said open end of said waveguide radiates through an opening in one of said walls into said cavity.

13. A microwave oven excitation system comprising:

an oven cavity having top, bottom, and side walls, one wall of which comprises an entrant wall having a feed aperture formed therein;

a magnetron including a radiating antenna probe;

a waveguide open at one end for coupling microwave energy to said cavity, said waveguide being mounted on said entrant wall outside said oven cavity with said one end of said waveguide being aligned with said feed aperture, said waveguide being terminated at the other end thereof by a conductive end wall having an opening formed centrally therein, said probe extending into the interior of said waveguide through said opening in said end wall; and a cup-like member for capacitively coupling microwave energy from said antenna probe to said waveguide, said cup-like member being mounted within said waveguide perpendicular to the axis of propagation of said waveguide, and inverted over said probe concentric therewith, said cup-like member being dimensioned to provide a matched load condition for said magnetron, with a clearance between said cup-like member and said end wall defining an annular gap therebetween.

14. The excitation system of claim 13, wherein said cup-like member is mounted in said waveguide for rotation about the axis of propagation of the waveguide;

said system further comprising at least one generally planar conductive arm lying substantially in a plane perpendicular to the axis of propagation of said waveguide and extending radially from said cup-like member, said arm being operative to block radiation into said oven cavity from that region of said waveguide between said arm and said end wall, and means for rotating said cup-like member, whereby such rotation varies the radiation pattern in said cavity.

15. The excitation system of claim 14 wherein said waveguide is of generally circular configuration, having a diameter not substantially greater than one wavelength and a length not substantially greater than one-half wavelength, and wherein the axial projection of said probe into said guide is not substantially greater than one quarter wavelength.

16. The excitation system of claim 15 wherein the cylindrical portion of said cup-like member comprises a plurality of closely spaced axially extending vanes, and wherein said means for rotating said cup-like member comprises a blower for directing cooling air over said magnetron, and means for directing at least a portion of said cooling air into said waveguide to strike said vanes, thereby rotating said cup.

17. The excitation system of claim 13 wherein said cup-like member comprises a generally cylindrical member having a circular planar portion disposed perpendicular to said axis of propagation and a hollow, generally cylindrical portion extending axially from said planar portion toward said end wall, the diameter and length of said cylindrical member being selected to provide a matched load condition for said magnetron.

18. The excitation system of claim 17 wherein said waveguide is of generally circular configuration, having a diameter not substantially greater than one wavelength and a length not substantially greater than one-half wavelength, and wherein the axial projection of said probe into said guide is not substantially greater than one quarter wavelength.

19. The excitation system of claim 13 wherein said cup-like member comprises a hollow truncated conical portion with a radially outwardly extending annular flange formed about said conical section.

20. The excitation system of claim 19 wherein the diameter of said circular waveguide is not substantially greater than one wavelength, the length of said waveguide is not substantially greater than one-half wavelength, and the axial projection of said probe into said guide is not substantially greater than one quarter wavelength.

* * * * *